US005223852A

United States Patent [19]

Oresti et al.

[11] Patent Number: 5,223,852

[45] Date of Patent: Jun. 29, 1993

[54] METHODS AND APPARATUS FOR PRINTING ONTO CABLE JACKET

[75] Inventors: Joseph Oresti; Robert Lablans; Rodger J. Bacon, all of Kingston, Canada

[73] Assignee: Northern Telecom Limited, Montreal, Canada

[21] Appl. No.: 751,477

[22] Filed: Aug. 29, 1991

[51] Int. Cl.[5] ..... B41J 2/01; B05D 3/08; B41F 17/10; H01B 7/36

[52] U.S. Cl. ..... 346/1.1; 346/140 R; 346/75; 101/35; 101/488; 264/132; 427/223

[58] Field of Search ..... 101/35, 487, 488; 346/1.1, 75, 140 R; 400/126; 427/223, 421, 422; 118/46; 425/90-94; 264/132

[56] References Cited

U.S. PATENT DOCUMENTS

| | | | |
|---|---|---|---|
| 4,073,992 | 2/1978 | Lerman et al. | 101/488 X |
| 4,534,313 | 8/1985 | Louvel | 346/140 R X |
| 4,906,170 | 3/1990 | Nelson et al. | 400/126 X |

FOREIGN PATENT DOCUMENTS

| | | |
|---|---|---|
| 0166925 | 1/1986 | European Pat. Off. . |
| 2944103 | 5/1981 | Fed. Rep. of Germany . |

*Primary Examiner*—Benjamin R. Fuller
*Assistant Examiner*—Alrick Bobb
*Attorney, Agent, or Firm*—R. J. Austin

[57] ABSTRACT

Printing onto a cable jacket in which while the cable moves along a passline in "in-line" production, a longitudinally extending band of the jacket is treated with an oxidizing gas flame to provide an oxidized surface and a jet printer prints a legend onto the surface. The method is of particular use when the jacket is formed from materials, e.g. polyethylene to which ink does not normally adhere readily.

4 Claims, 1 Drawing Sheet

METHODS AND APPARATUS FOR PRINTING ONTO CABLE JACKET

Figure 1:
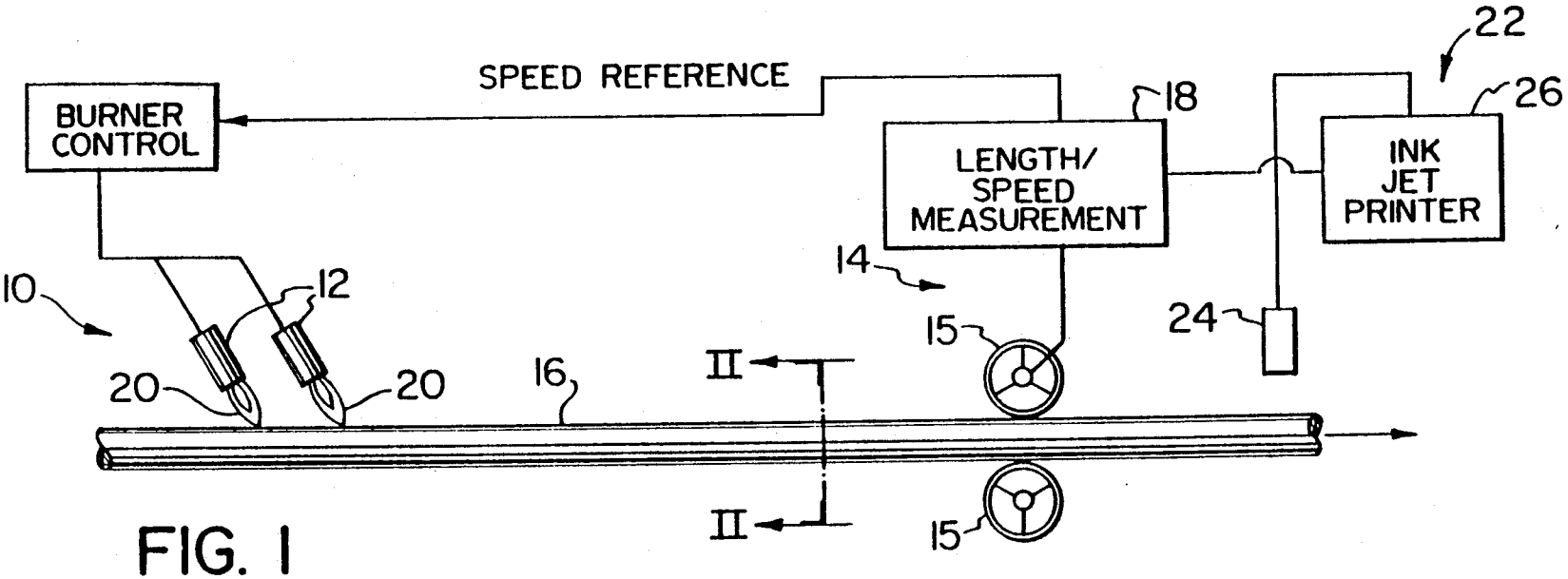

This invention relates to methods and apparatus for printing onto cable jacket.

One of the last steps performed in the manufacture of electrical cable is the printing of a legend conveying information relevant to the cable structure upon the outsides of the cable jacket. While the cable is moved along a passline and through a printing station, legends are printed upon the jacket at intervals with each legend including a statement of the distance of that legend from the leading end of the cable. Hence, the legends are intended to provide the manufacturer with cable information pertaining to cable lengths.

It has been conventional practice to print the legends by the use of indent printer devices which indent the jacket surface with information and apply the print into the indentations. With such a technique, should any of the print be removed from the jacket, the legend is still readable by virtue of the presence of the indentations and the information is thereby retained. However, indent printer devices suffer from slippage upon cable jackets and, as a result, it is commonplace for the distance statements in the legends to be inaccurate. The slippage increases as cable throughput speed increases and the recorded measurements may be at least as great as 2.5% smaller than the actual measurements of cable. Such inaccurate information does, of course, result in a monetary loss to the manufacturer when he relies upon the legends for measurement accuracy.

More recently, indent printer devices are being superceded by ink jet printers which are computer controlled and provide legends accurately recording distances along cable from its leading end as the cable is fed progressively through a printing station. While it has been found that ink from ink jet printers adheres readily and permanently to certain jacket materials, e.g. polyvinylchloride, adherence problems have been found with other jacket materials, e.g. polyolefins and in particular polyethylene. On polyolefins, the ink is readily - removable. After the printing process, cable passes through further processing stages such as through a capstan and reeling apparatus and at such stages the dried ink is easily dislodged either by contact or by locally stressing the surface of the jacket. As ink jet printers do not indent the jacket, then no decipherable message remains once the ink has been removed.

The present invention provides a process for applying ink to a cable jacket which seeks to overcome the above problems.

According to one aspect of the invention there is provided a method of printing onto a cable jacket comprising:- passing the cable progressively along a passline through a surface preparation station and treating a longitudinally extending surface band of the cable jacket with an oxidizing gas flame means to oxidize the surface band; and then moving the cable downstream and through a printing station and in the printing station printing a legend onto the oxidized surface band by directing ink onto the band from an ink jet printer.

It has been found that with the surface oxidized in the manner according to the invention, the printing ink remains upon the cable jacket even through further processing stages and during installation of cable.

In a preferred method, the cable is also passed through a means responsive to cable speed and provide signals to cause operation of the ink jet printer at intervals to print legends onto the cable jacket, the legends being spaced specific distances apart along the cable. The speed responsive means is preferably also operable by the speed of the cable to control the operation of the oxidizing gas flame means. For instance, the cable may need to move along the passline at approximately 5 m/min to commence operation of a single gas jet for a single oxidizing gas flame. A single gas jet may suffice to provide sufficient oxidization of the surface band up to cable speeds of approximately 30 m/min after which the speed responsive means causes actuation of at least one other gas jet to apply an oxidizing gas flame at the surface band. At the higher speeds, the additional gas jet or jets will then provide sufficient oxidation of the surface band as the cable passes through the preparation station.

The invention also includes an apparatus for printing onto a cable jacket comprising:- an oxidizing gas flame means disposed in a surface preparation station on a passline for cable; ink jet printer means operable to direct ink in controlled manner towards the cable, the ink jet printer means disposed downstream along the passline from the surface preparation station; and a means responsive to the speed of cable moving along the passline for controlling the operation of the gas flame means of the ink jet printer means.

Figure 2:
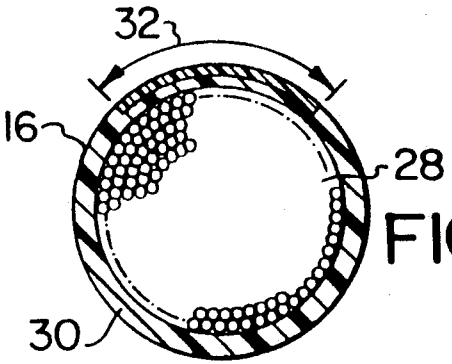

One embodiment of the invention will now be described, by way of example, with reference to the accompanying drawings, in which:

FIG. 1 is a diagrammatic side elevational view of apparatus for printing onto a cable jacket, the apparatus being shown in use; and FIG. 2, to a larger scale than FIG. 1, is a cross-sectional view taken along line II—II in FIG. 1.

As shown in FIG. 1, apparatus for printing legends onto a cable jacket comprises an oxidizing gas flame means 10 disposed in a surface preparation station along a passline for cable. The oxidizing gas flame means comprises two oxidizing gas flame burners 12, disposed in tandem along the passline. Downstream along the passline is provided a means responsive to cable speed in the form of a cable speed measurement device 14 which is of conventional construction and comprises two counter wheels 15 disposed one on each side of the passline for engaging opposite sides of cable 16 as it moves along the passline. The measurement device 14 is connected to a burner control 18 of the oxidizing gas flame means 10 so as to control the operation of the burners 12. The burner control comprises two solenoids (not shown) for operating the two gas burners 12 and these solenoids are operated by electrical signals received from the measurement device 14.

It is intended that the cable 16 passing through the apparatus will be provided by one or both of the gas burners with a longitudinally extending surface band which is oxidized by flame treatment. If the cable is travelling at less than 5 m/min then any gas flame directed at the cable could cause an unacceptable large degree of oxidation to the jacket surface. At speeds above 5 m/min, the speed measurement device 14 sends an electrical signal to a solenoid for one of the burners 12 so that the burner operates to direct a flame against the jacket surface to produce an acceptable oxidized surface band extending longitudinally of the cable. However, with cable speeds in excess of 30 m/min, a single burner is insufficient to provide sufficient oxidization of the jacket surface to satisfactorily retain print upon the surface band. At such higher speeds the speed measurement device 14 sends a further electrical signal to operate the solenoid for the second burner 12. Hence, at speeds in excess of 30 m/min, both the burners 12 are actuated to apply, in tandem, two flames 20 onto the cable surface so that there is an increase of oxidation of the surface as required.

Downstream from the speed measurement device 14 is disposed an ink jet printer means 22. This ink jet printer means has an ink jet head 24 and an ink jet printer control 26 which is computer operated. A suitable printer control is that made by Videojet and sold as "Videojet III" printer control head. The printer control 26 is actuated by the speed measurement device 14 to operate the head 24 at intervals to apply a legend to the outside surface of the cable jacket in the oxidized surface band area.

The distance between the oxidizing gas flame means 10 and the ink jet printer means 22 and print head 24 should be sufficient to ensure there is no damage to the printer means or to the ink. However, while being consistent with this, the distance should be as small as possible to ensure that the print head 24 is aligned with the oxidized surface band of the cable and that normal rotational movement of the cable as it moves along its passline does not rotate the surface band out of the sphere of operation of the print head 24.

In use, the cable 16 to be passed through the apparatus comprises a cable core 28 (FIG. 2) surrounded by a polyethylene jacket 30. As the cable moves beneath one or both of the flames 20 from the burners 12, a longitudinally extending surface band 32 of the jacket is treated so that the surface band oxidizes to a certain degree sufficient to retain print to be applied downstream to the jacket. The band 32 may subtend an angle of between 60° and 90° around the cable axis. The cable then proceeds through the speed measurement device 14 which controllably operates one or both burners, dependent upon cable speed, and the ink jet printer control 26 as described above. As the cable passes beneath the print head 24, the print head is actuated at specific intervals through the control 26 so as to apply a succession of spaced and desired legends to the outside of the cable jacket. These legends are applied upon the band 32 so that they will remain adhered to the cable. Each of the legends contains information relevant to the cable construction and also includes information relating to the distance of each particular legend from the leading end of the cable.

As may be seen from the above-described embodiment, the use and method of the embodiment overcome problems associated with applying permanently adhered printed legends to polyethylene jacketed cable.

We claim:

1. A method of printing onto a cable jacket comprising:

passing the cable progressively along a passline through a surface preparation station and treating a longitudinally extending surface band of the cable jacket with an oxidizing gas flame means to oxidize the surface band, and controlling operation of the oxidizing gas flame means by passing the cable through a means responsive to cable speed to oxidize the surface band in a desired manner;

then moving the cable downstream and through a printing station and in the printing station printing a legend onto the oxidized surface band by directing ink onto the band from an ink jet printer while controlling operation of the ink jet printer with the means responsive to cable speed.

2. A method according to claim 1 wherein the oxidizing gas flame means comprises at least two gas burners relatively disposed in tandem along the passline and directed at the cable jacket, the method comprising controlling the oxidizing gas flame means by having one of the gas burners operational to oxidize the surface band for cable throughput speeds below a certain threshold speed and having both of the gas burners operational to oxidize the surface band for cable throughput speeds above the certain threshold speed.

3. An apparatus for printing onto a cable jacket comprising:

an oxidizing gas flame means disposed in a surface preparation station on a passline for cable;

ink jet printer means operable to direct ink in controlled manner towards the cable, the ink jet printer means positioned downstream along the passline from the surface preparation station; and a means responsive to the speed of cable moving along the passline for controlling operation of the gas flame means and of the ink jet printer means.

4. Apparatus according to claim 3 wherein the oxidizing gas flame means comprises at least two burners relatively disposed in tandem along the passline, and the means responsive to cable speed is operable to provide a signal to ensure that one of the gas burners is operational to oxidize the surface band for cable throughput speeds below a certain threshold speed and is operable to provide a signal to ensure that both of the burners are operational to oxidize the surface band for cable throughput speeds above the certain threshold speed.

* * * * *